US011791565B2

(12) United States Patent
Lier et al.

(10) Patent No.: US 11,791,565 B2
(45) Date of Patent: Oct. 17, 2023

(54) APERTURE ANTENNA ARRAYS WITH APERTURE MESH

(71) Applicant: Lockheed Martin Corporation, Bethesda, MD (US)

(72) Inventors: Erik Lier, Lakewood, CO (US); Paul Jeffrey Nelson, Highlands Ranch, CO (US)

(73) Assignee: Lockheed Martin Corporation

( * ) Notice: Subject to any disclaimer, the term of this patent is extended or adjusted under 35 U.S.C. 154(b) by 17 days.

(21) Appl. No.: 17/498,130

(22) Filed: Oct. 11, 2021

(65) Prior Publication Data

US 2023/0114625 A1 Apr. 13, 2023

(51) Int. Cl.

| | |
|---|---|
| ***H01Q 21/06*** | (2006.01) |
| ***H01Q 19/02*** | (2006.01) |
| ***H01Q 21/00*** | (2006.01) |

(52) U.S. Cl.

CPC ..... *H01Q 21/064* (2013.01); *H01Q 19/027* (2013.01); *H01Q 21/005* (2013.01); *H01Q 21/067* (2013.01)

(58) Field of Classification Search

CPC .. H01Q 21/064; H01Q 19/027; H01Q 21/067; H01Q 13/02; H01Q 21/0043; H01Q 21/005; H01Q 13/10; H01Q 13/0275; H01Q 21/00

See application file for complete search history.

(56) References Cited

U.S. PATENT DOCUMENTS

| | | | | |
|---|---|---|---|---|
| 10,320,085 | B1 | 6/2019 | Lier et al. | |
| 10,454,186 | B2 * | 10/2019 | Boyanov | H01Q 21/0087 |
| 10,594,045 | B2 * | 3/2020 | Kirino | H01Q 21/064 |
| 10,749,252 | B1 | 8/2020 | Lier et al. | |
| 11,411,292 | B2 * | 8/2022 | Kirino | H05B 6/806 |
| 2005/0104791 | A1 | 5/2005 | Sun et al. | |

FOREIGN PATENT DOCUMENTS

| | | | | |
|---|---|---|---|---|
| CA | 3049202 | A1 * | 2/2020 | H01Q 1/288 |
| EP | E P-2493018 | A1 * | 8/2012 | H01Q 13/0275 |
| WO | WO-2009031794 | A1 * | 3/2009 | H01Q 13/00 |
| WO | WO-2018070566 | A1 * | 4/2018 | H01Q 13/02 |

OTHER PUBLICATIONS

Multi-Layer Planar Grid Structure Polarizer for Reconfigurable Polarization. KR 101822947 B1, Mar. 8, 2018. Park et al. (Year: 2018).*

Ordek, Sezgin et al., "Horn Array Antenna Design For Ku-Band Applications," 2015 9th International Conference on Electrical and Electronics Engineering, pp. 351-354, Nov. 26-28, 2015.

(Continued)

*Primary Examiner* — Vibol Tan

(57) ABSTRACT

Provided herein are various enhanced arrangements for arrays of aperture antennas, such as horn antennas or short backfire antennas. Examples include an array of aperture antennas having a wall thickness between apertures, and a conductive mesh positioned above the apertures such that openings of the conductive mesh are aligned with the apertures and positioned having a selected spacing between the conductive mesh and the apertures.

20 Claims, 8 Drawing Sheets

(56) References Cited

OTHER PUBLICATIONS

Silver, Samuel, "Microwave Antenna Theory And Design," First Edition, 10.15 The Box Horn,, pp. 377-380, 1949.
Vettikalladi, Hamsakutty et al., "High Gain And High Efficient Stacked Antenna Array With Integrated Hom For 60 GHz Communication Systems," International Journal of Antennas and Propagation, vol. 2014, 9 pages, Apr. 22, 2014.
Young, Leo et al., "Meander-Line Polarizer," IEEE Transactions on Antennas and Propagation, pp. 376-378, May 1973.
Zhang, J. C. et al., "Multifunctional Meander Line Polarizer," Progress in Electromagnetics Research Letters, vol. 6, pp. 55-60, 2009.

* cited by examiner

APERTURE ANTENNA ARRAYS WITH APERTURE MESH

TECHNICAL BACKGROUND

Aperture antennas are a form of radio frequency (RF) antenna used for directed transmission and reception of various RF signals, often employed in microwave radio transmissions or in reflector antenna feed systems. One example aperture antenna, horn antennas, comprise a source port which feeds into a flared horn volume surrounded by horn walls that define the general shape of the horn antenna. A horn aperture or opening then transmits/receives signals to/from external nodes. Arrays of horn antennas can be formed and used to produce multibeam Electrically Steerable Arrays (ESAs). ESAs are often deployed on satellites placed into various orbital configurations for communication with earth-based stations over a range of aiming configurations.

When employed for microwave and millimeter-wave RF applications, horn arrays and connected waveguide filters offer low loss and high efficiency as compared to other antenna types. One measure of performance for horn arrays is aperture efficiency. Aperture efficiency of horn arrays can be degraded due to horn wall thickness which produce spacing between each horn aperture of the array. Wall thicknesses result in a gain decrease proportional to frequency. So-called "knife edge" horn walls are difficult to manufacture, require costly machining operations, and also inhibit use of less costly manufacturing operations such as injection molding without incurring additional post-injection machining of the horn walls. Moreover, thin horn walls sacrifice mechanical rigidity of horn arrays and require delicate handling and mounting. Thus, practical horn array designs require a minimum wall thickness that produces gaps or spacing between each of the corresponding horn apertures. Resultant horn aperture area for horn arrays is limited by these gaps, particularly for higher frequency applications. Some techniques have been employed to increase performance of horn antenna arrays, such as endfire elements (e.g. disc on rod). However, these endfire elements add height, increase mutual coupling, and increase cost.

OVERVIEW

Wall thicknesses between antenna elements in aperture antenna arrays, such as arrays formed with horn antennas, result in gain decreases for the array. Manufacturing walls thin enough to recover this lost gain can be difficult to achieve without exotic materials or manufacturing processes. Discussed herein are several techniques and structures for producing arrays of aperture antennas having enhanced gain characteristics. A gain enhancing mesh (GEM) is formed and placed near the apertures of an array. This gain-enhancing mesh can be formed from a grid of conductive members having mesh openings which coincide with the apertures and are offset a selected spacing away from the apertures. The gain-enhancing mesh can be integrated into a meander-line polarizer, aperture cover, radome, or moisture/dust cover of the antenna array. Once deployed, the gain-enhancing mesh can increase the gain for an array of aperture antennas. Use of the gain-enhancing mesh can also allow for less expensive techniques to manufacture the aperture antennas which cannot as easily form thin walls. Specifically, the gain-enhancing mesh can compensate for thicker walls of aperture antennas while providing array gains commensurate with thinner walls.

In one example implementation, a system includes an array of aperture antennas having a wall thickness between apertures, and a conductive mesh positioned above the apertures such that openings of the conductive mesh are aligned with the apertures and positioned having a selected spacing between the conductive mesh and the apertures.

In another example implementation, an apparatus includes a conductive mesh comprising a grid of conductive material having a pattern concordant with apertures of an array of aperture antennas. The apparatus also includes a frame coupled along a perimeter of the conductive mesh and configured to couple the conductive mesh at an offset distance from the apertures of the array of the aperture antennas and provide alignment between openings of the conductive mesh and the apertures.

In yet another example implementation, a method includes forming a conductive mesh comprising a grid of conductive material having a pattern concordant with apertures of an array of aperture antennas, and coupling the conductive mesh to a frame along a perimeter of the conductive mesh, wherein the frame is configured to provide alignment between openings of the conductive mesh and the apertures when the frame is applied to the array of the aperture antennas. The method also includes establishing a spacing feature configured to provide an offset distance for the conductive mesh when the frame is applied to the array of the aperture antennas.

This Overview is provided to introduce a selection of concepts in a simplified form that are further described below in the Detailed Description. It may be understood that this Overview is not intended to identify key features or essential features of the claimed subject matter, nor is it intended to be used to limit the scope of the claimed subject matter.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

Aperture antennas are often employed in microwave RF transmissions, such as in antenna feed systems or multibeam Electrically Steerable Arrays (ESAs). Aperture antennas and associated arrays are a class of antennas which emit RF energy from a corresponding aperture or opening, and include horn antennas, short backfire antennas, and waveguide aperture antennas. Antenna elements for aperture arrays should be designed with high aperture efficiency to achieve high gain and low sidelobe patterns. For medium earth orbit (MEO) and geostationary earth orbit (GEO) satellite antennas, the element size is typically 2-3 wavelengths. One type of aperture antenna, horn antennas, comprise a source port which feeds into a flared horn volume surrounded by horn walls that define the general shape of the horn antenna. Arrays of horn antennas can be formed by joining together many individually-manufactured horn antennas or by forming a plurality of horn elements with a unified workpiece. Various subtractive or additive manufacturing techniques can be employed. However, use of plastic injection molding to manufacture horn arrays has been limited due to minimal thicknesses achievable for the walls of horns within the array. As mentioned above, increases in wall thicknesses between antennas in antenna arrays result in gain decreases for the array. Ideally, horn aperture wall thicknesses should be infinitely thin to allow for effective radiation from the entire aperture. A finite area of the wall directly results in gain reduction. Thin walls are difficult to manufacture for use at higher frequencies like Ku-band, Ka-band, or millimeter wavelengths.

Discussed herein are several techniques and structures for producing arrays of aperture antennas having enhanced gain characteristics, while still allowing for various manufacturing techniques such as injection molding. A gain enhancing mesh (GEM) is formed and placed near the antenna aperture of an array. Electromagnetic waves of the RF transmissions couple to the grid structure of the GEM within a near-field region and re-radiate, resulting in gain enhancement for the array. The mesh can be integrated into meander-line polarizers or an aperture cover (e.g. radome, dust cover, or moisture cover) of the antenna array which can further increase performance and provide protection from foreign object debris (FOD) or the local environment. Also, although horn antennas and associated arrays are discussed herein in FIG. 1-7, it should be understood that the GEM techniques can be applied to other types and configurations of aperture antennas, such as short backfire antennas. An example short backfire antenna is shown in FIG. 8. It also applies to any aperture shape, such as hexagonal, octagonal, circular, elliptical, triangular, or irregular. Advantageously, the structures and techniques herein can increase the gain of an aperture antenna array for realistic wall thicknesses and keep manufacturing cost down.

Figure 1:
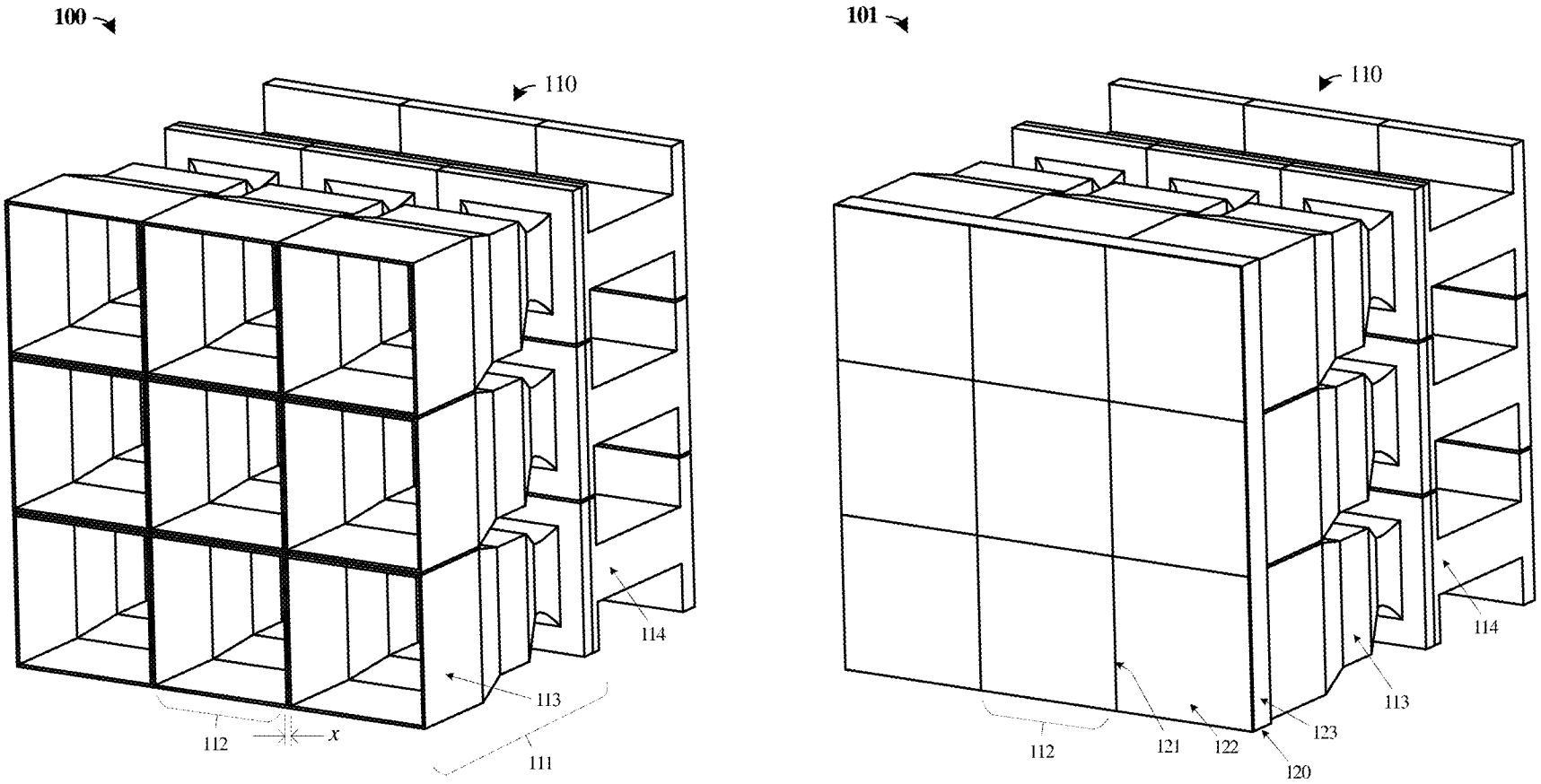
FIG. 1 illustrates a horn antenna array in an implementation.

FIG. 1 is now presented which illustrates one example antenna array that employees a gain-enhancing mesh structure. FIG. 1 includes view 100 and view 101, each of which illustrate antenna array 110. View 100 shows antenna array 110 without mesh assembly 120, while view 101 shows antenna array 110 with mesh assembly 120. Antenna array 110 comprises a plurality of horn antennas abutted into a 3×3 array. While horn antenna arrays, such as ESAs, can employ a greater quantity of horn antennas, the 3×3 quantity in FIG. 1 is employed for clarity. Also, although square or rectangular horn antennas and arrays with associated meshes are discussed, it should be understood that any shape of horn antenna or other suitable waveguide-style antenna can be employed with correspondingly-shaped meshes, such as hexagonal, octagonal, circular, elliptical, irregular, multi-shaped aperiodic, and the like.

As mentioned, a 3×3 array of individual horn antennas 111 forms array 110. Each horn antenna 111 includes horn walls 113 which form apertures 112. Waveguide filters 114 can be optionally included to filter and/or separate polarizations of input/output signals for each horn antenna 111 and to couple to further waveguide elements and transmitter/receiver elements. As shown in FIG. 1, the formation of array 110 includes formation of abutted horn walls establishing wall thicknesses between each aperture. These thicknesses are shown by metric 'x' in FIG. 1 and 'x' corresponds to twice the thickness of each individual wall of the horns employed in array 110. Increases in wall thicknesses between horn antennas 111 in array 110 result in gain decreases for array 110. Ideally, 'x' should be infinitesimal to allow for effective radiation from the entire aperture, but practical limitations on materials and manufacturing processes produces a thickness which can affect performance of array 110.

View 101 illustrates array 110 combined with mesh assembly 120. Mesh assembly 120 comprises conductive mesh 121 which forms openings 122. Mesh assembly 120 is offset by a selected distance from the face of array 110 having apertures 112. In FIG. 1, this offset is maintained by spacer material 123. Spacer material 123 is configured to be positioned between apertures 112 and conductive mesh 121 to establish the offset distance. The offset distance can affect the performance of array 110, and a proper offset distance is selected to obtain target performance or increase in gain for array 110. The selected spacing is selected to produce a target gain over a frequency range for radio frequency signals carried by the array, such as approximately between one tenth and one half of a wavelength in thickness. Spacer material 123 can comprise a frame only along a perimeter of mesh assembly 120, or might span the entire area formed by mesh assembly 120. When spanning the entire area, spacer material 123 comprises a material generally transparent to associated radio frequency energy such that communications can pass through spacer material 123.

Conductive mesh 121 comprises at least one layer of conductive elements coupled together and arranged into a grid. Conductive mesh 121 is a grid of conductive material having a pattern that matches the horn apertures of the array. A width of the conductive material (in a plane of the conductive mesh layer) is less that the thickness of horn walls between the horn apertures. Example materials include conductive wires, traces, thin film metals, or composite/organic materials having conductive properties. Various structural materials can be employed to support conductive mesh 121 and maintain a shape or opening characteristics of conductive mesh 121, such as perimeter frames, RF-transparent sheets or films, Kapton (polyimide) layers, multilayer printed circuit materials, composites, plastics, organic or inorganic materials, and the like. In some examples, conductive mesh 121 is formed onto a layer of material, such as Kapton. Example materials for spacer material 123 include Rohacell® HF foam materials when RF signals are desired to pass through spacer material 123, or can be any suitable insulating, dielectric, or non-conductive structural material. Spacer material 123 provides offset and insulation between material of horn walls 113 (apertures 112) and conductive mesh 121. Other configurations and material selections are discussed below. Conductive mesh 121 can be conductively coupled to horn walls 113 or to a common reference potential (e.g. ground potential) of the array to reduce or protect from electrostatic discharge (ESD) in vacuum by providing a discharge pathway for accumulation of charge on conductive mesh 121.

During manufacturing and/or operation, mesh assembly 120 can be coupled to array 110 to produce an assembly having greater RF performance than array 110 alone. Conductive mesh 121 of mesh assembly 120 compensates for the finite thickness 'x' from horn walls 113, especially when abutted horn antennas create a thickness a factor of two greater than any individual horn wall. Conductive mesh 121 above the horn walls acts as a virtual thin wall or knife edge which is unachievable for horn walls alone made with traditional materials or manufacturing processes. Conductive mesh 121 might be 1-10 mils (thousandths of an inch) wide, which can thus taper off the thickness 'x' of the horn walls and extend apertures 112 into a virtually thin wall, enhancing the aperture efficiency. In one example, such as for a 1000-element horn antenna array, a 0.4 dB increase can be realized when using a conductive mesh on individual 19.6 dB gain horns. With this conductive mesh, the 1000-element array can achieve 50 dB gain, which would require 100 more horn elements to achieve a similar gain when the conductive mesh is not employed. An increase in radiating element gain directly translates to an increase in total array gain. Moreover, greater improvements in performance can be achieved as array operating frequencies increase, due to horn walls becoming a greater fraction of wavelength. Also, this conductive mesh has a negligible impact to axial ratio and return loss.

Figure 2:
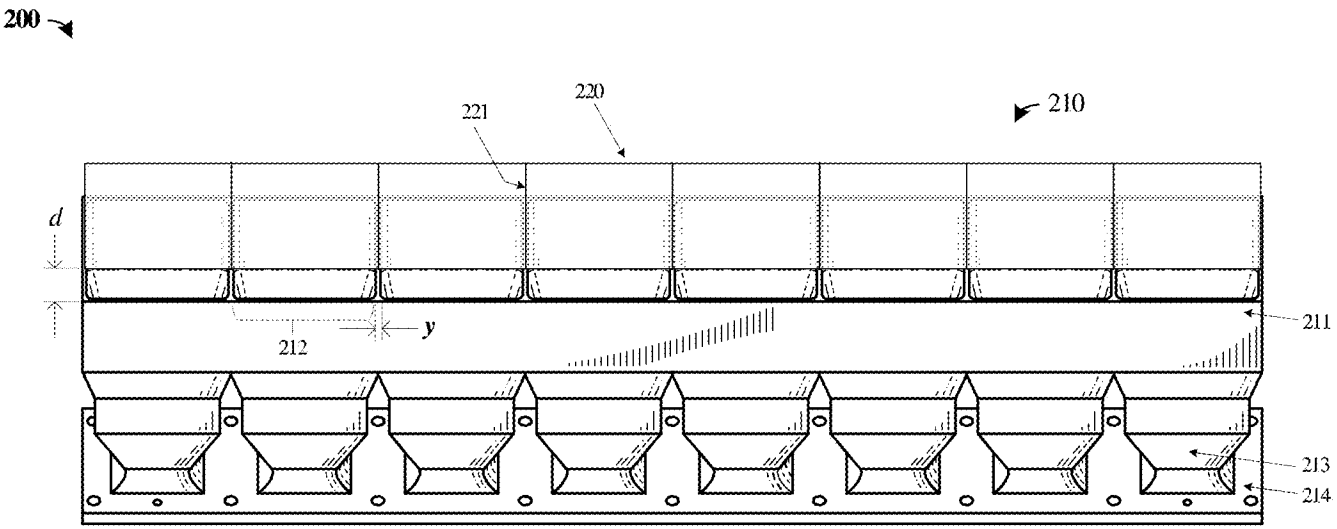
FIG. 2 illustrates a horn antenna array in an implementation.

FIG. 2 illustrates another example implementation of a horn array that includes a gain-enhancing conductive mesh. In FIG. 2, a linear array 210 of eight (8) horn elements is shown, each having a corresponding horn aperture 212 formed by horn wall 213. Array 210 is formed from a single workpiece in FIG. 2, such as from a machined metal part or injection-molded process. Flange 214 can couple array 210 to other portions of an RF system, such as other transmitter/receiver elements, amplifiers, filters, polarizers, and the like. As with FIG. 1, a thickness is established by the walls of each horn element, which reduces an effective width of each aperture 212, noted by metric 'y' in FIG. 2. Mesh assembly 220 is included in FIG. 2 and coupled to array 210. Mesh assembly 220 is formed from a linear grid of eight segments of conductive mesh 221. Conductive mesh 221 is positioned a distance 'd' away from apertures 212 of array 210. While a spacer is not shown in FIG. 2 for clarity, one could be included as described herein.

Figure 3:
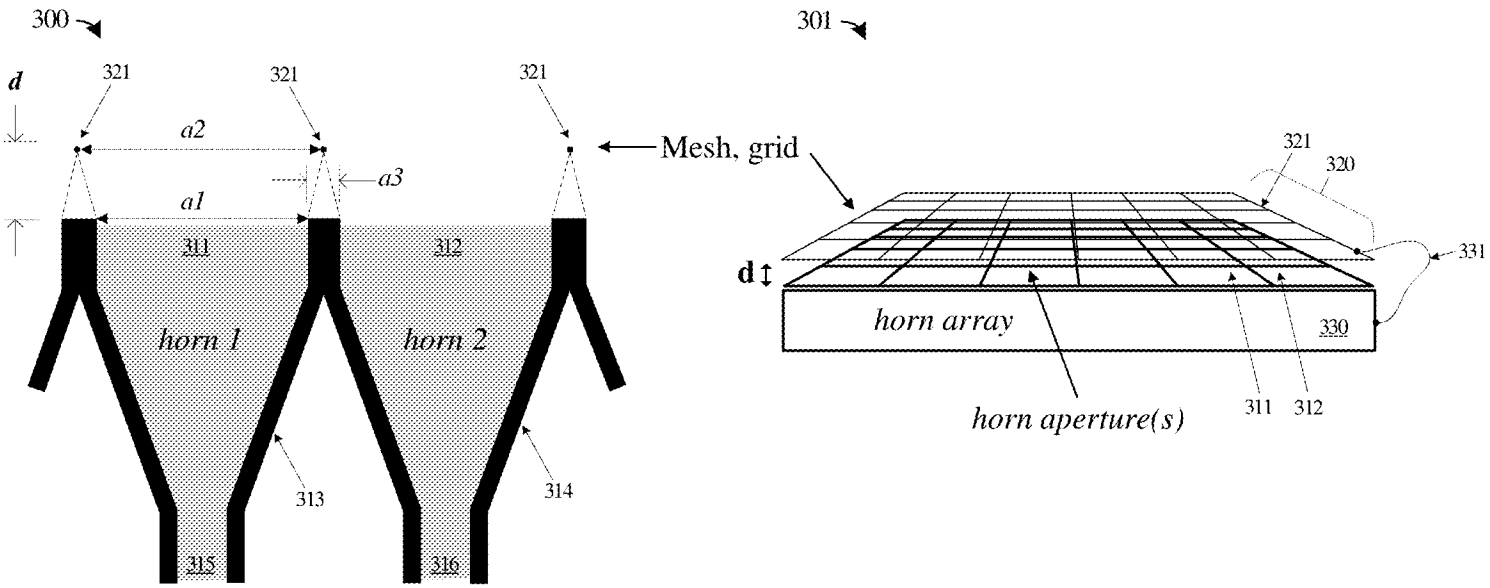
FIG. 3 illustrates a horn antenna grid arrangement in an implementation.

To further describe the operations and characteristics of a gain-enhancing mesh, FIG. 3 is presented. FIG. 3 includes views 300 and 301. View 300 shows a cross-sectional or side view schematic of an antenna array formed from horn antennas and having a gain-enhancing mesh applied thereto. View 301 shows a perspective view of a corresponding antenna array with a gain-enhancing mesh, for which the elements of view 300 can be employed.

Turning first to view 300, two horn antennas are shown in cross-section having a horn volume defined by horn walls 313-314, as well as source ports 315-316 and apertures 311-312. The material of horn walls 313-314 forms a material thickness 'a3' that reduces an aperture size 'a1' of the apertures from an ideal aperture size 'a2', and has the effect of reducing gain for the associated antenna array. To increase this aperture size, a conductive mesh is employed above apertures 311-312, noted by elements 321 in view 300. Elements 321 comprise conductive elements having an offset height 'd' from apertures 311-312. This configuration creates a virtual aperture or knife edge to the existing apertures 311-312 and increases the aperture size from 'a1' to approximately 'a2'. Since the thickness of the conductive elements forming conductive mesh 321 can be made much thinner than that of horn walls 313-314, a much thinner aperture is established for each horn antenna.

Turning to view 301, an example antenna array 330 that employs elements of view 300 is shown. Conductive mesh 321 is offset from array 330 by offset distance 'd' and the openings of conductive mesh 321 are arranged to coincide with the apertures of the horn elements of array 330. Assembly 320 can be formed from conductive mesh 321 which includes a perimeter frame and offset/alignment features. Moreover, conductive mesh 321 is conductively coupled over conductive connection 331 to horn array 330, typically to the same reference potential as the associated horn walls. This conductive coupling can reduce or protect from ESD by providing a discharge pathway for accumulation of charge on conductive mesh 321. Transmitted RF signals can propagate 'upward' though the horn antennas and then conductive mesh, while received RF signals can propagate 'downward' though the conductive mesh and then horn antennas. The RF signals couple to grid structure of conductive mesh 321 within a near-field region and re-radiate, resulting in gain enhancement for the array.

Figure 4:
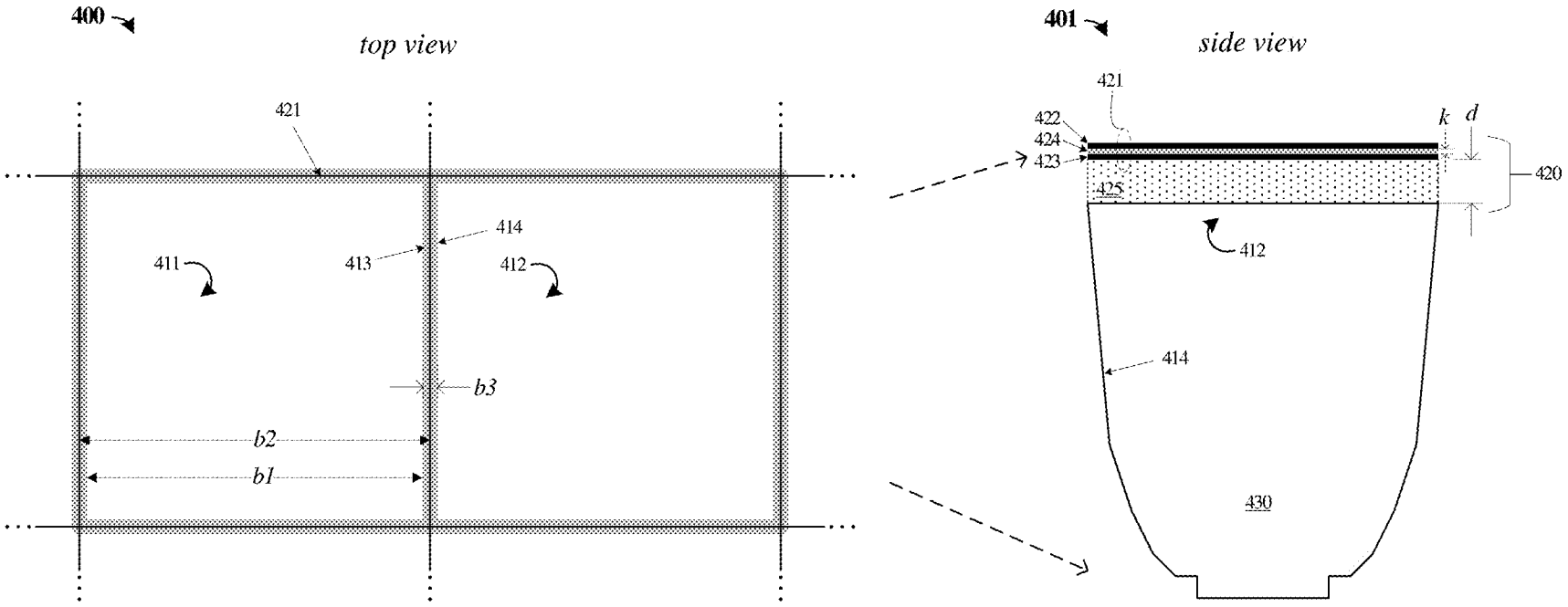
FIG. 4 illustrates a horn antenna grid arrangement in an implementation.

FIG. 4 illustrates further configurations for horn antennas that employ conductive mesh features as well as example implementations for the conductive mesh assemblies. FIG. 4 includes views 400 and 401. View 400 shows a top view of a portion of an antenna array, and view 401 shows a cross-sectional or side view schematic of one example horn antenna from the antenna array. While two example horn elements are shown in view 400, it should be understood that an array of a greater quantity of horn elements can be employed.

Turning first to view 400, two horn antennas are shown in a top view. Horn walls 413-414 form apertures 411-412 which have aperture widths 'b1' and intervening wall thicknesses 'b3' between adjacent horn elements. Conductive mesh 421 is positioned above apertures 411-412 such that openings of conductive mesh 421 are aligned with apertures 411-412. Similar to that mentioned for FIG. 3, conductive mesh 421 has the effect of increasing a width of the apertures for the horn antennas to an aperture width of 'b2'.

Side view 401 shows a stack-up of conductive mesh 421 which is a part of assembly 420 coupled to horn antenna 430. Conductive mesh 421 is formed from at least one conductive layer 422-423 separated by a RF-transparent (non-conductive or dielectric) substrate layer 424. Assembly 420 also includes spacer element 425 which couples conductive mesh 421 to horn element 430 and can provide structural support and planar alignment to conductive mesh 421. As mentioned, conductive mesh 421 may be a multi-layer configuration. More than one conductive layer can be employed when a single layer might not provide enough thickness for the particular application. For example, conductive mesh 421 can be formed using various printed circuit processes, such as traces printed or deposited onto a dielectric substrate. In FIG. 4, this dielectric substrate can comprise a Kapton polyimide film having copper traces deposited or clad onto a top and bottom face. The copper traces form conductive mesh 421 and substrate 424 provides structural support for the copper traces as well as allows for formation of the grid arrangement. Other forms of printed circuit substrates or conductive materials can be employed, and more or less than two conductive layers might be formed with intervening substrate layers.

In one example, the Kapton material (dK=3.1, df=0.0005) is approximately 1 mil thick, with 5 mil wide copper traces ($\sigma$=5.8e7) forming a conductive grid. The horn wall material might also comprise copper ($\sigma$=5.8e7), or might instead be formed from polymer or composite materials that are plated with copper or other metallic coating. Material for spacer element 425 can comprise Rohacell HF51 material (dK=1.07, df=0.0021), with an appropriate offset 'd' which is selected based on the desired operating frequency range and targeted gain properties. For example, 'd' might be approximately 0.1λ-0.5λ(in units of wavelength). Radiation efficiency, defined as the ratio of radiated power over accepted power, quantifies the total loss through the structure (excluding VSWR mismatch). In FIG. 4, the insertion loss due to spacer element 425, substrate 424, and conductive layers 422-423 is estimated to be ~0.02 dB at the Ku-band. This insertion loss is an order of magnitude smaller than expected directivity improvement from usage of conductive mesh 421. Advantageously, a net improvement in gain is achieved with conductive mesh 421 within assembly 420 when applied to horn antenna 430 and an array of such horn antennas. In addition to use to assembly 420, modification of the flare stages of the horn elements can be varied to improve return loss by optimizing the initial flare sections.

Figure 5:
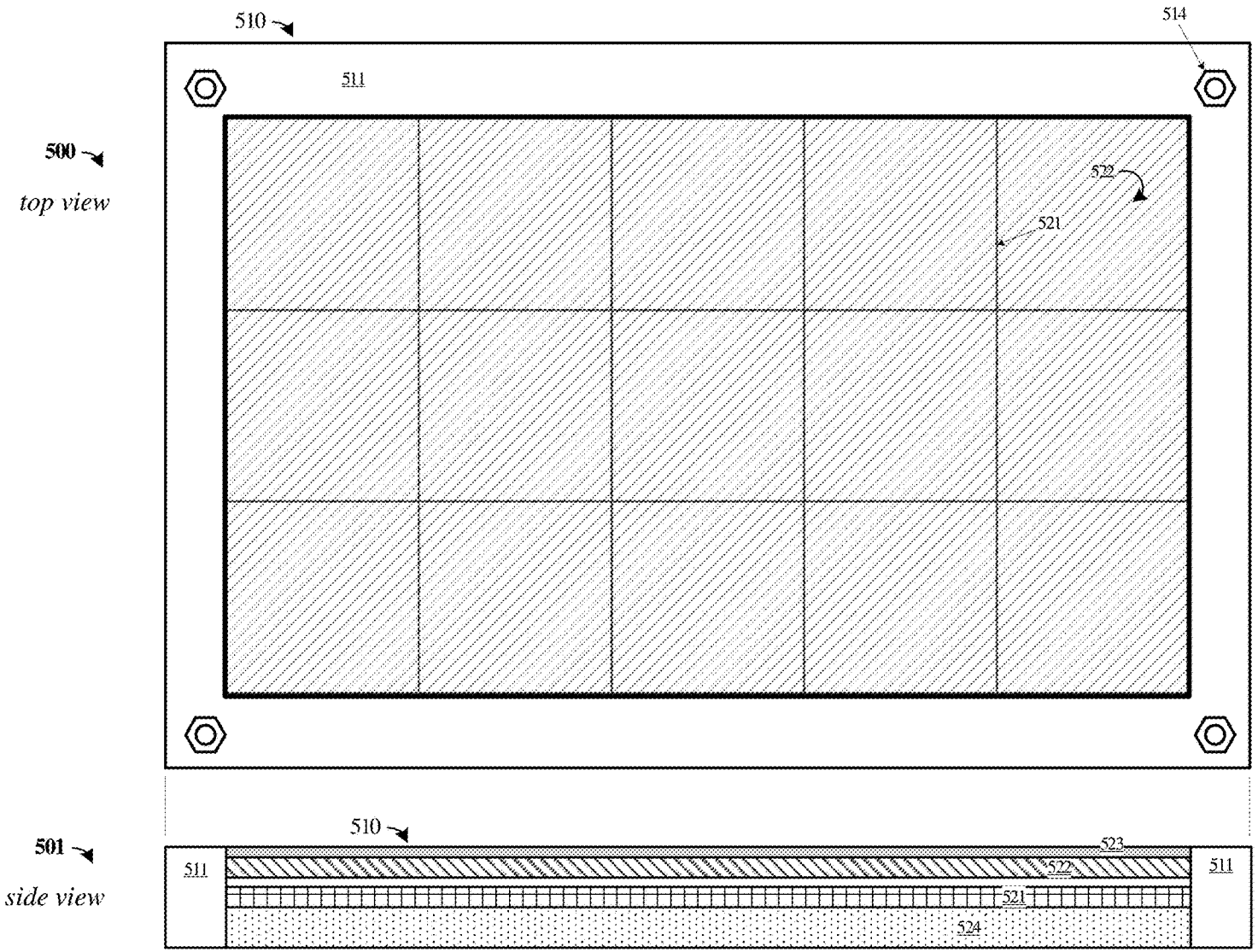
FIG. 5 illustrates a horn antenna grid panel in an implementation.

FIG. 5 illustrates a gain-enhancing conductive mesh in the context of cover assembly 510. Cover assembly 510 can be coupled over an array of aperture antennas, such as horn antennas, using attachment features 514. Cover assembly 510 includes perimeter frame 511, conductive grid 521, meander-line polarizer 522, cover 523, and spacer 524. In this example, an array of up to fifteen (15) horn antennas (3×5 array) can be supported. Similar assemblies can be sized to suit various arrays and quantities of individual horn elements of such arrays.

View 500 shows a top view of cover assembly 510 having perimeter frame 511 surrounding conductive mesh 521 and meander-line polarizer 522. Perimeter frame 511 can comprise various structural elements and materials which are coupled to further elements of cover assembly 510 and provides structural support, alignment, and fastener features (514) to couple to an associated horn array. Specifically, perimeter frame comprises a frame coupled along a perimeter of the corresponding horn array and configured to couple cover assembly 510 above the horn apertures with a selected spacing while maintaining planar alignment between the horn apertures and the openings of conductive mesh 521 of cover assembly 510.

Conductive mesh 521 is formed from a grid of conductive elements formed onto a substrate layer. Meander-line polarizer is also formed from conductive elements formed onto a substrate layer. Typically, conductive mesh 521 is nearer to the apertures of the horn antennas than meander-line polarizer 522. Cover 523 can comprise a separate layer from conductive mesh 521 and meander-line polarizer 522, or be formed from the same layers. Cover 523 forms a protective cap or cover over the associated horn antennas to prevent debris, water/moisture intrusion, FOD, dust, biological matter, or other contaminants from entering the horn volumes of the array. Cover 523 may comprise a radome or other similar structure.

Further details of layers of cover assembly 510 are shown in view 501. View 501 shows a side view of cover assembly 510 having several layers forming a stack-up of materials. At the edges is perimeter frame 511 which structurally supports the various layers, and can be clamped, fastened, or otherwise bonded to the layers with adhesives. Starting from the bottom of side view 501, spacer 524 comprises an RF-transparent material which structurally supports the other layers and establishes a selected spacing between conductive mesh 521 and the apertures of a horn array. The selected spacing is selected to produce a target gain over a frequency range for radio frequency signals carried by the array. The selected spacing can be tuned by empirical testing to produce the greatest gain, or according to other factors, such as frequency range, power levels, spacer materials, achievable manufacturing processes, and the like.

Next, conductive mesh 521 is formed from one or more layers of conductive material, traces, or wires deposited, printed, or etched onto an RF-transparent substrate, such as a Kapton substrate. The individual members that form conductive mesh 521, such as traces or wires, have a width (in a plane of the conductive mesh layer) less than the expected thickness between horn antenna walls of an array. A quantity of layers or planes of the members that form conductive mesh 521 is selected to achieve a target thickness of the conductive mesh in the direction of RF propagation (e.g. perpendicular to the conductive mesh layer). The target thickness can be tuned by empirical testing to produce the greatest gain, or according to other factors, such as frequency range, power levels, achievable manufacturing processes, and the like.

A gap might be established between conductive mesh 521 and meander-line polarizer 522, or these functional layers might be formed onto the same substrate or layers of substrate, such as a multi-layer printed circuit board or Kapton flexible circuit assembly. Meander-line polarizer 522 comprises a set of meandering conductive lines or wires that alter polarization of propagating RF signals, such as from linear polarization to circular polarization (or vice-versa). Cover 523 is shown as an upper layer in view 501 to protect the other layers from external environments. However, it should be understood that cover 523 might comprise another layer or be formed from the materials of conductive mesh 521, meander-line polarizer 522, or spacer 524. Cover 523 comprises various RF-transparent materials, such as Kapton, polyimide, polymers, composites, glasses, or other substrate materials discussed herein. When polyimide is employed, such as Kapton, a 1 mil thickness can be employed. Other thicknesses of cover 523 can be employed depending upon the application and expected environment.

To manufacture an assembly that employs cover assembly 510, a conductive mesh comprising a grid of conductive material is formed and positioned having a pattern concordant with apertures of an array of horn antennas. The conductive mesh can be formed by at least establishing a quantity of layers of conductive features coupled to a non-conductive substrate, where the quantity of layers is selected to achieve a target thickness of the conductive mesh. The conductive mesh can be coupled to a frame along a perimeter of the conductive mesh, where the frame is configured to provide alignment between openings of the conductive mesh and the apertures when the frame is applied to the array of the horn antennas. A spacing feature is established which is configured to provide an offset distance for the conductive mesh when the frame is applied to the array of the horn antennas.

During operation, cover assembly 510 can be coupled to a horn array to produce an assembly having greater gain than the array would without cover assembly 510. Conductive mesh 521 compensates for the finite thickness from horn walls that form the array, especially when abutted horn antennas create a thickness a factor of two greater than any individual horn wall. Conductive mesh 521 above the horn walls acts as a virtual thin wall or knife edge which is unachievable for horn walls alone. Conductive mesh 521 might be 1-5 mils wide, which can thus substantially taper off the thickness of the horn walls and extend horn apertures into a virtually thin wall, enhancing the aperture efficiency. An increase in radiating element gain directly translates to an increase in total array gain. Moreover, greater improvements in performance can be achieved as array operating frequencies increase, due to horn walls becoming a greater fraction of wavelength.

Figure 6:
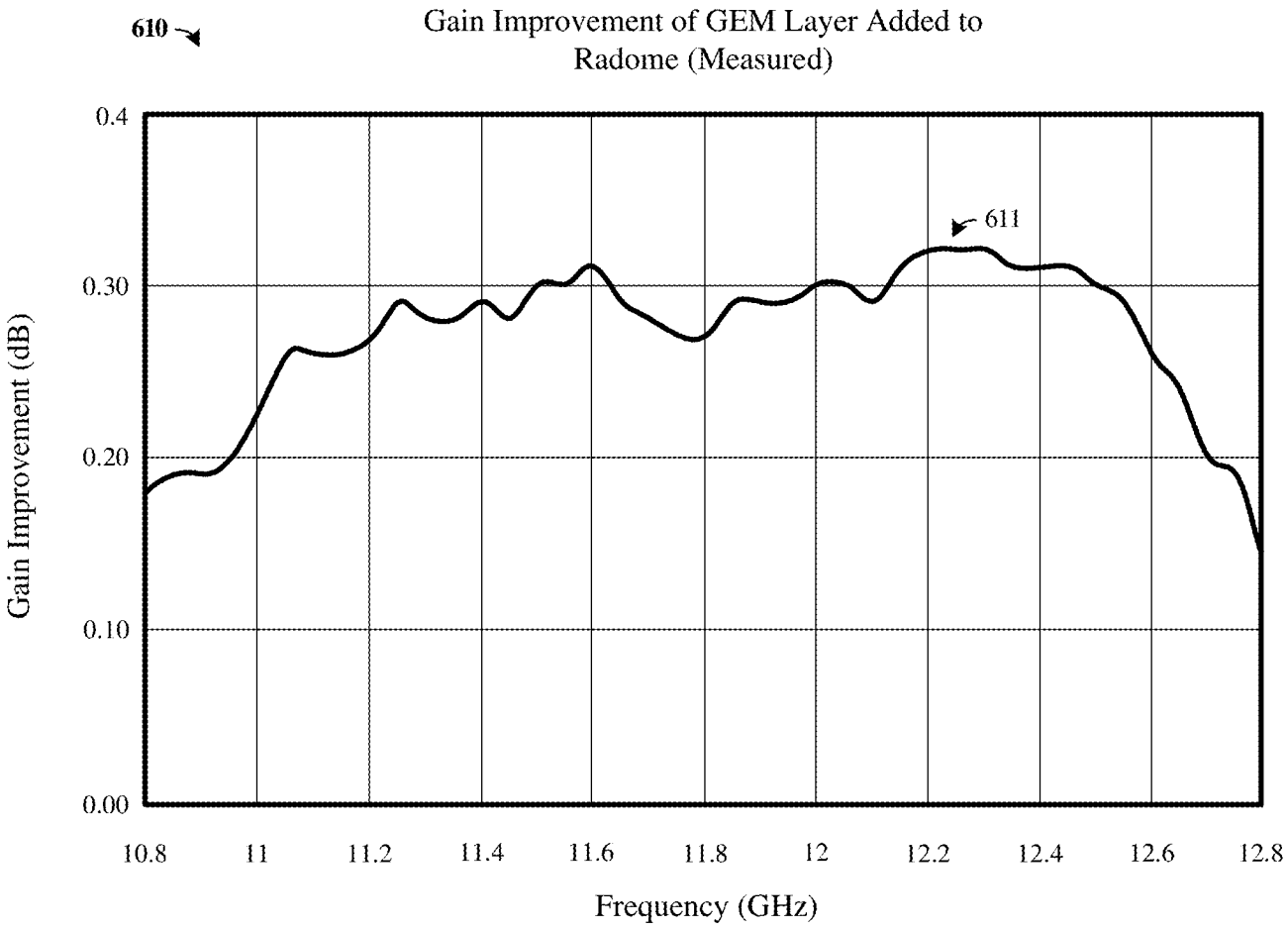
FIG. 6 illustrates performance of a horn antenna grid in an implementation.
Figure 7:
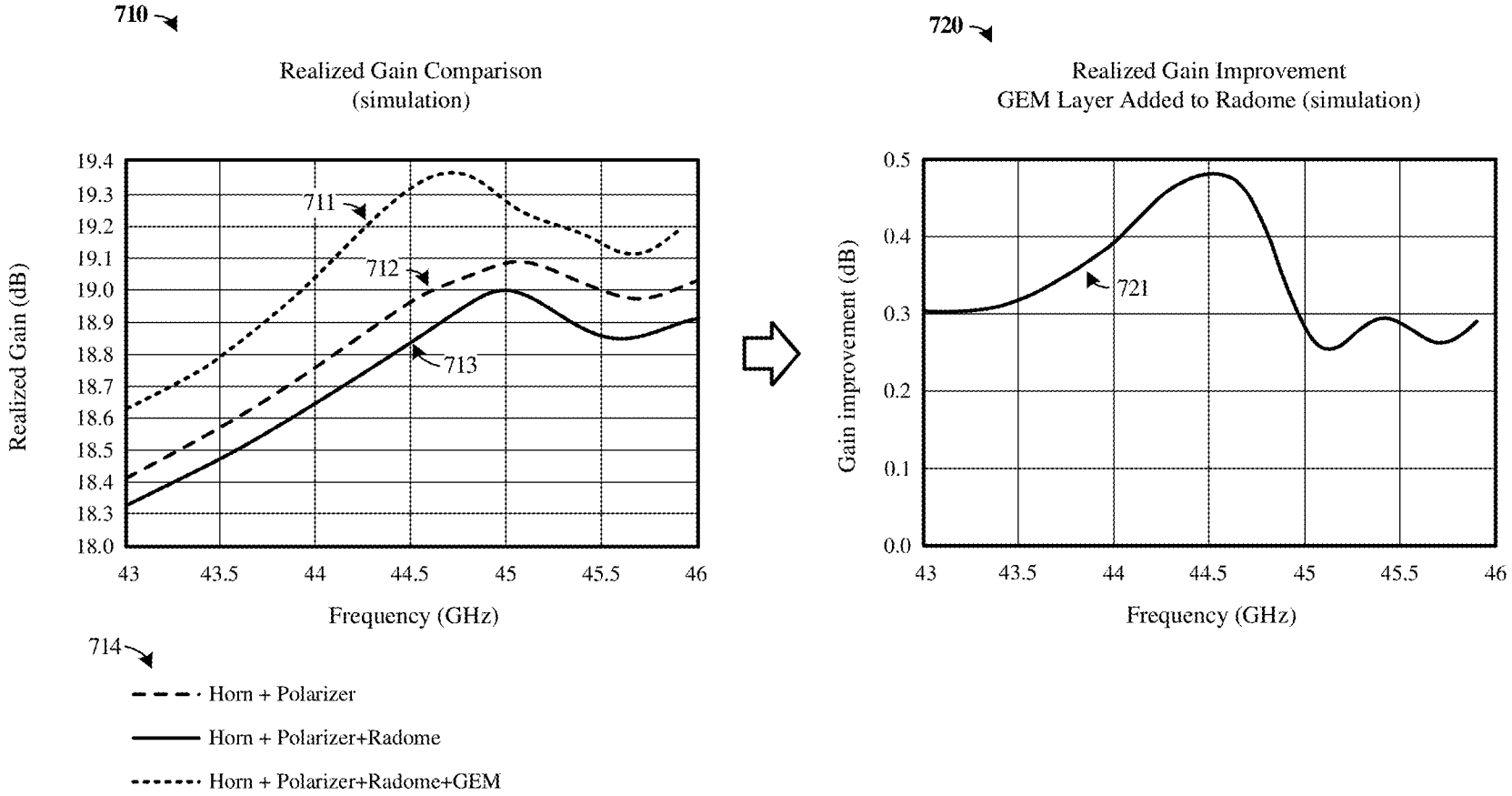
FIG. 7 illustrates performance of a horn antenna grid in an implementation.
Figure 8:
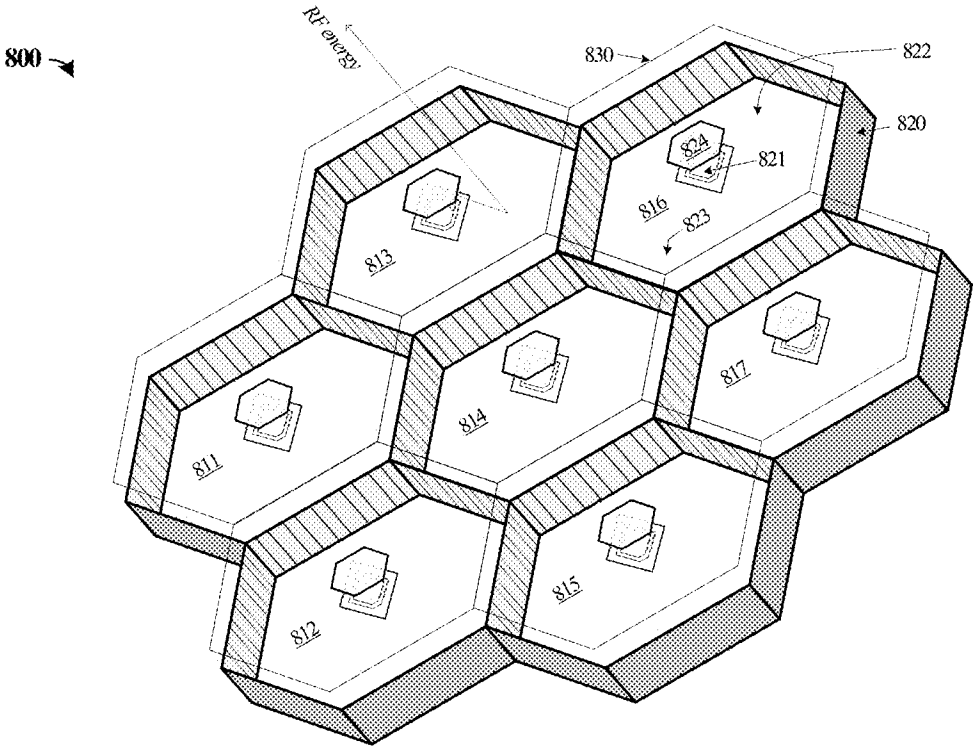
FIG. 8 illustrates a short backfire antenna array in an implementation.

FIGS. 6 and 7 show two example sets of performance characteristics for horn antenna arrays that employ gain-enhancing mesh (GEM) features. FIG. 6 shows graph 610 detailing measured gain improvement when a GEM layer is added to a cover of a 3×5 horn array. This configuration may comprise a horn array that employs cover assembly 510 or similar assemblies. Meander-line features might be omitted. As can be seen in graph 610, a vertical axis shows gain improvement in decibels (dB) over a frequency range roughly corresponding to the Ku band from 10.8 gigahertz (GHz) to 12.8 GHz. Gain performance curve 611 shows a gain improvement of approximately 0.3 dB compared to a horn array with a cover but no GEM layer.

FIG. 7 shows graphs 710 and 720 detailing simulated gain performance for various configurations of horn arrays. Specifically, graph 710 shows a realized gain performance for three configurations of a horn array: with meander-line polarizer (curve 712), with meander-line polarizer and radome (curve 713), and with meander-line polarizer with radome and GEM (curve 711). Legend 714 shows which curve corresponds to which configuration. Graph 710 covers a frequency range of 43-46 GHz on the horizontal axis and a realized gain in dB on the vertical axis. As can be seen in graph 710, substantial performance increases are realized using the GEM configuration (711). Graph 720 shows realized gain improvement, as with the metrics shown in graph 610. As can be seen in graph 720, a vertical axis shows gain improvement in dB over a frequency range roughly corresponding to the extremely high frequency (EHF) range of 43-46 GHz. Gain performance curve 721 shows a simulated gain improvement of approximately 0.5 dB compared to a horn array with a radome but no GEM layer. As compared to graph 610, curve 721 of graph 720 shows a greater performance improvement at higher frequencies due to thicker walls of the horn antennas as a fraction of wavelength. Typically, the addition of the GEM has a negligible impact to axial ratio and return loss.

FIG. 8 illustrates advanced short backfire antenna (A-SBFA) array 800 in an implementation. Array 800 includes a plurality of short backfire antennas 811-817, each having a corresponding antenna wall and antenna feed element. Antenna 816 has wall 820, feed element 821, aperture 822, main reflector 823, and sub-reflector 824 labeled for clarity, and the other antennas include similar elements. In addition to antennas 811-817, conductive mesh 830 is included and positioned above the apertures of each of the antennas in array 800. In operation, RF energy is radiated by (or incident on) array 800 and is received (or transmitted) by individual ones among antennas 811-817 via an associated feed element and sub-reflector (e.g. 821/824) in conjunction with a main reflector (e.g. 823). Array 800 can couple to other portions of an RF system (not shown for clarity), such as transmitter/receiver elements, amplifiers, filters, polarizers, and the like.

Walls of antennas 811-817, which define the corresponding apertures, can be formed from a conductive material or non-conductive material coated or laminated with conductive surface material, such as a liner comprising various anisotropic impedance surface features. Each wall will have a corresponding thickness due to the limitations of the manufacturing techniques used to produce antennas 811-817. This thickness reduces an effective width of each aperture. Conductive mesh 830 is included in FIG. 8 and coupled to array 800. Conductive mesh 830 is formed from a hexagonal grid of seven segments of conductive wire or printed traces. Conductive mesh 830 is positioned a selected distance away from the apertures of array 800, as discussed herein for other arrays. While a spacer is not shown in FIG. 8 for clarity, one could be included to establish this selected distance. Moreover, conductive mesh 830 can be electrically or conductively coupled to a reference potential similar to that of the walls of antennas 811-817 to mitigate ESD and other factors. As with the other examples herein, conductive mesh 830 might be included in frame or along with various aperture covers, radomes, polarizers, and the like. More than one layer of conductive material can be employed to form conductive mesh 830.

The functional block diagrams, operational scenarios and sequences, and flow diagrams provided in the Figures are representative of exemplary systems, environments, and methodologies for performing novel aspects of the disclosure. While, for purposes of simplicity of explanation, methods included herein may be in the form of a functional diagram, operational scenario or sequence, or flow diagram, and may be described as a series of acts, it is to be understood and appreciated that the methods are not limited by the order of acts, as some acts may, in accordance therewith, occur in a different order and/or concurrently with other acts from that shown and described herein. For example, those skilled in the art will understand and appreciate that a method could alternatively be represented as a series of interrelated states or events, such as in a state diagram. Moreover, not all acts illustrated in a methodology may be required for a novel implementation.

The various materials and manufacturing processes discussed herein are employed according to the descriptions above. However, it should be understood that the disclosures and enhancements herein are not limited to these materials and manufacturing processes, and can be applicable across a range of suitable materials and manufacturing processes. Thus, the descriptions and figures included herein depict specific implementations to teach those skilled in the art how to make and use the best options. For the purpose of teaching inventive principles, some conventional aspects have been simplified or omitted. Those skilled in the art will appreciate variations from these implementations that fall within the scope of this disclosure. Those skilled in the art will also appreciate that the features described above can be combined in various ways to form multiple implementations.

What is claimed is:

1. A system, comprising:

an array of aperture antennas having walls defining individual apertures;

a conductive mesh comprising a grid of conductive material having a pattern concordant with the apertures of the array; and the conductive mesh positioned above the apertures with a spacer material configured to align and offset the conductive mesh such that openings of the conductive mesh are aligned with the apertures and have a selected spacing between the conductive mesh and the apertures.

2. The system of claim 1, wherein the array of aperture antennas has aperture shapes comprising at least one among square, rectangular, hexagonal, octagonal, circular, elliptical, irregular, or aperiodic.

3. The system of claim 1, wherein a thickness of the conductive material is less that a wall thickness between the apertures.

4. The system of claim 1, comprising:

a frame coupled along a perimeter of the array and configured to couple the conductive mesh above the apertures with the selected spacing and maintain planar alignment between the apertures and the openings of the conductive mesh.

5. The system of claim 1, comprising:

the conductive mesh comprising conductive features formed onto a substrate that provides structural support to the conductive mesh to at least maintain the openings of the conductive mesh.

6. The system of claim 5, wherein the substrate comprises a Kapton or polyimide layer onto which the conductive features are established.

7. The system of claim 1, comprising:

the conductive mesh comprising a quantity of layers of conductive features coupled to a substrate, wherein the quantity of layers is selected to achieve a target thickness of the conductive mesh.

8. The system of claim 1, wherein the spacer material is generally transparent to radio frequency energy and positioned between the apertures and the conductive mesh.

9. The system of claim 1, comprising:

an aperture cover for the array comprising the conductive mesh.

10. The system of claim 1, comprising:

a meander-line polarizer for the array, wherein the conductive mesh is positioned between the apertures and conductive features of the meander-line polarizer.

11. The system of claim 1, wherein the selected spacing is selected to produce a target gain over a frequency range for radio frequency signals carried by the array.

12. An apparatus, comprising:

a conductive mesh comprising a grid of conductive material having a pattern concordant with apertures of an array of aperture antennas; and a frame coupled along a perimeter of the conductive mesh and configured to couple the conductive mesh at an offset distance from the apertures of the array of the aperture antennas and provide alignment between openings of the conductive mesh and the apertures.

13. The apparatus of claim 12, comprising:

a spacer material generally transparent to radio frequency energy and configured to be positioned between the apertures and the conductive mesh to establish the offset distance.

14. The apparatus of claim 12, comprising:

the conductive mesh comprising conductive features formed onto a substrate that provides structural support to the conductive mesh to at least maintain the openings of the conductive mesh.

15. The apparatus of claim 14, wherein the substrate comprises a Kapton or polyimide layer onto which the conductive features are established.

16. The apparatus of claim 12, comprising:

the conductive mesh comprising a quantity of layers of conductive features coupled to a substrate, wherein the quantity of layers is selected to achieve a target thickness of the conductive mesh.

17. The apparatus of claim 12, comprising:

an aperture cover for the array comprising the conductive mesh.

18. The apparatus of claim 12, comprising:

a meander-line polarizer coupled to the frame and having a spacing relative to the conductive mesh, wherein the meander-line polarizer is configured to be positioned beyond the conductive mesh when applied to the array.

19. A method, comprising:

forming a conductive mesh comprising a grid of conductive material having a pattern concordant with apertures of an array of aperture antennas; and coupling the conductive mesh to a frame along a perimeter of the conductive mesh, wherein the frame is configured to provide alignment between openings of the conductive mesh and the apertures when the frame is applied to the array of the aperture antennas;

establishing a spacing feature configured to provide an offset distance for the conductive mesh when the frame is applied to the array of the aperture antennas.

20. The method of claim 19, further comprising:

forming the conductive mesh by at least establishing a quantity of layers of conductive features coupled to a non-conductive substrate, wherein the quantity of layers is selected to achieve a target thickness of the conductive mesh.

* * * * *